US010060220B2

(12) United States Patent
Prescott et al.

(10) Patent No.: US 10,060,220 B2
(45) Date of Patent: Aug. 28, 2018

(54) SUBSEA PROTECTION SYSTEM

(71) Applicant: Fluor Technologies Corporation, Sugar Land, TX (US)

(72) Inventors: Clifford Neal Prescott, Houston, TX (US); Phillip Nguyen, Houston, TX (US); Thomas A. Ralph, Sugar Land, TX (US); Charles W. Stockton, Houston, TX (US); John W. Henderson, Houston, TX (US)

(73) Assignee: Fluor Technologies Corporation, Sugar Land, TX (US)

( * ) Notice: Subject to any disclaimer, the term of this patent is extended or adjusted under 35 U.S.C. 154(b) by 0 days.

(21) Appl. No.: 15/087,136

(22) Filed: Mar. 31, 2016

(65) Prior Publication Data

US 2016/0290097 A1 Oct. 6, 2016

Related U.S. Application Data

(60) Provisional application No. 62/140,714, filed on Mar. 31, 2015.

(51) Int. Cl.

| | |
|---|---|
| ***E21B 34/04*** | (2006.01) |
| ***E21B 33/037*** | (2006.01) |
| ***E21B 33/064*** | (2006.01) |
| ***E21B 41/00*** | (2006.01) |

(52) U.S. Cl.

CPC ..... *E21B 34/04* (2013.01); *E21B 33/037* (2013.01); *E21B 33/064* (2013.01); *E21B 41/0007* (2013.01)

(58) Field of Classification Search

CPC ..... E21B 34/04; E21B 33/037; E21B 33/064; E21B 41/0007

See application file for complete search history.

(56) References Cited

U.S. PATENT DOCUMENTS 3,063,500 A * 11/1962 Logan ..... E21B 33/037 166/351
3,396,544 A * 8/1968 Manning ..... B63B 22/021 114/257
3,572,278 A * 3/1971 Knapp et al. ..... B63B 22/021 114/263

(Continued)

FOREIGN PATENT DOCUMENTS

| | | |
|---|---|---|
| CA | 2981452 | 10/2016 |
| WO | 2016161149 A1 | 10/2016 |
| WO | 20171553 A1 | 9/2017 |

OTHER PUBLICATIONS

PCT Application No. PCT/US16/25329, International Search Report and Written Opinion, dated Jun. 29, 2016, 14 pages.

(Continued)

*Primary Examiner* — Matthew R Buck
*Assistant Examiner* — Aaron L Lembo
(74) *Attorney, Agent, or Firm* — Conley Rose, P.C.

(57) ABSTRACT

A subsea wellbore protection (SWP) system. The SWP system includes a wellbore penetrating a subterranean formation beneath a sea floor and a SWP structure positioned below-grade with respect to the sea floor. The SWP structure comprises a caisson that encloses a first wellbore equipment component. The first wellbore equipment component is in fluid communication with the wellbore.

20 Claims, 8 Drawing Sheets

(56) References Cited

U.S. PATENT DOCUMENTS 3,592,263 A * 7/1971 Nelson ..... E21B 33/037 166/351
3,643,447 A * 2/1972 Pogonowski ..... E02B 17/00 114/257
3,703,207 A * 11/1972 Horton ..... E21B 33/037 166/337
3,910,056 A * 10/1975 Dopyera ..... F16L 1/123 405/211
4,123,858 A * 11/1978 Batchelder ..... B63C 11/38 114/333
4,127,950 A * 12/1978 Tillinghast ..... E02F 3/90 37/309
4,273,472 A 6/1981 Piazza et al.
4,335,740 A * 6/1982 Boley ..... E02D 29/12 137/364
4,456,071 A * 6/1984 Milgram ..... E21B 43/0122 166/356
4,558,744 A 12/1985 Gibb
4,655,642 A * 4/1987 Birdy ..... E02B 17/0021 249/10
4,762,442 A 8/1988 Thomas et al.
4,902,169 A * 2/1990 Sutton ..... E02B 17/021 405/196
5,018,904 A 5/1991 Thomas et al.
5,050,680 A * 9/1991 Diehl ..... E21B 33/037 137/312
8,122,618 B2 * 2/2012 Van Rompay ..... E02F 3/88 37/195
8,196,665 B2 * 6/2012 Wolinsky ..... E21B 43/0122 166/356
8,807,875 B2 8/2014 Shafer et al.
8,967,273 B2 * 3/2015 Ray ..... E21B 47/1025 166/337
2008/0093082 A1 4/2008 Sheshtawy
2009/0035067 A1 2/2009 Wilson et al.
2013/0043035 A1 2/2013 Hale
2014/0262311 A1 9/2014 Peterson et al.

OTHER PUBLICATIONS

PCT Application No. PCT/US16/25329, International Search Report and Written Opinion of the International Searching Authority, dated Jun. 29, 2016, 14 pages.
PCT Application No. PCT/US16/25329, International Preliminary Report on Patentability, dated Oct. 3, 2017, 10 pages.
Examination Report; Application No. GB1715681.1; dated Dec. 19, 2017; 2 pages.

* cited by examiner

SUBSEA PROTECTION SYSTEM

CROSS-REFERENCE TO RELATED APPLICATIONS

This application claims the benefit of U.S. Provisional Patent Application Ser. No. 62/140,714, filed on Mar. 31, 2015, and entitled "Ice Resistant Subsea Drilling and Production System," which is incorporated herein by reference in its entirety.

FIELD OF INVENTION

The subject matter disclosed herein relates to a subsea well protection system and methods of deploying and using the same. For example, the subsea well protection systems and the methods related to the same that are disclosed herein may be employed in the context of a subsea wellbore, for example, a hydrocarbon-producing wellbore that penetrates a geological formation beneath a body of water.

BACKGROUND

A subterranean formation (e.g., a geological formation or zone) beneath a body of water may serve as a source and/or a storage location for a natural resource, such as hydrocarbons or water and/or for the disposal of carbon dioxide or another material. The recovery of hydrocarbons, such as oil or gas, from a subterranean formation beneath a body of water presents challenges in addition to those encountered when seeking to recover hydrocarbons from a subterranean formation penetrated by a wellbore located elsewhere (e.g., on dry land). These additional challenges encountered in drilling, completion, production, injection, and post-production operations may be difficult, time-consuming, and expensive.

For example, subsea wells necessitate that wellbore servicing equipment be used during various operations (e.g., drilling, completion, stimulation, production, injection, or post-production operations) in a subsea environment, meaning that such equipment is exposed to open bodies of water and that operators do not experience the same level of control over the wellbore environment that operators working on dry land might. As such, equipment failure can yield catastrophic damage, for example, to the environment.

As such, what is needed are systems and methods for protecting subsea equipment and for reducing the threat of damage (e.g., environmental damage) resulting from subsea equipment failures in such environments.

SUMMARY

Disclosed herein is a subsea wellbore protection (SWP) system that includes a wellbore penetrating a subterranean formation beneath a sea floor and a SWP structure positioned below-grade with respect to the sea floor. The SWP structure comprises a caisson that encloses a first wellbore equipment component. The first wellbore equipment component is in fluid communication with the wellbore.

Also disclosed herein is a method of deploying a SWP system. The method comprises excavating a well-site to a depth below a sea floor. The method also discloses positioning a SWP structure within the excavated well-site and below-grade with respect to the sea floor. The SWP structure comprises a caisson that encloses a first wellbore equipment component.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Disclosed herein are embodiments of subsea well protection (SWP). The disclosed SWP systems and the methods related to the same may be employed in the context of a subsea wellbore, for example, a hydrocarbon-producing wellbore that penetrates a geological formation beneath a body of water.

Figure 1:
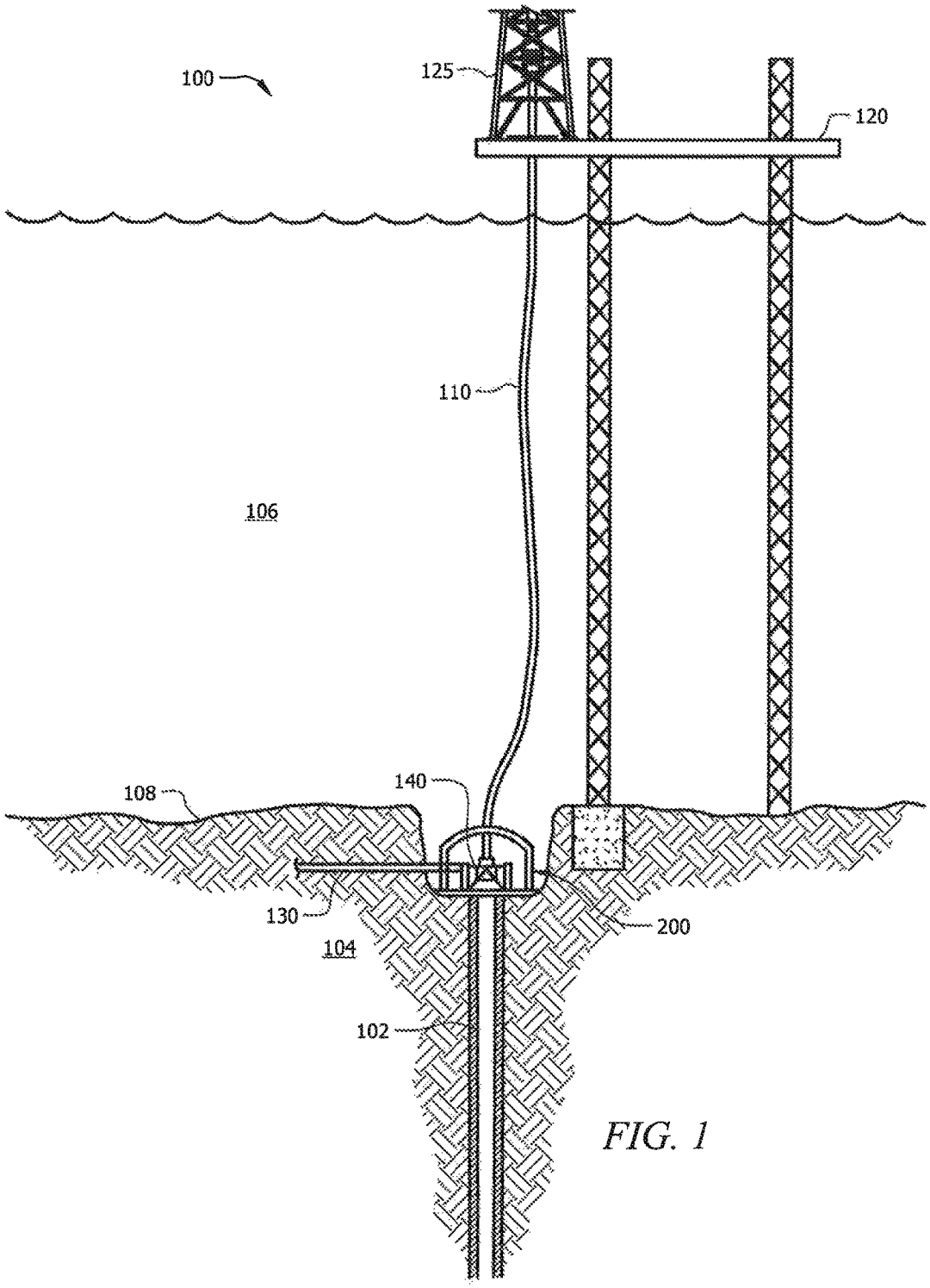
FIG. 1 illustrates an embodiment of an operating environment in which a SWP system may be deployed.

Referring to FIG. 1, an example of an operating environment of a SWP system 100 is shown. While the SWP system 100 of FIG. 1 is shown and described specifically with regard to certain features of the illustrated embodiment, various other features and embodiments of SWP systems consistent with the teachings described herein will also be appreciated by the person of ordinary skill in the art with the aid of this disclosure. As depicted, the operating environment comprises a wellbore 102 penetrating a subterranean formation 104 beneath a body of water 106, for example, for the purpose of recovering and/or storing hydrocarbons, water, and/or carbon dioxide. The wellbore 102 may be drilled into the subterranean formation 104 using any suitable drilling technique. The wellbore 102 may extend substantially vertically beneath the body of water 106 over a vertical wellbore portion or may deviate at any angle from the earth's surface over a deviated or horizontal wellbore portion. In various operating environments, all or portions of the wellbore may be vertical, deviated, horizontal, and/or curved.

In the embodiment of FIG. 1, the SWP system 100 also includes various subsea equipment employed in the production and/or storage of hydrocarbons, water, and/or carbon dioxide, referred to herein cumulatively as "hydrocarbon production equipment." For example, a riser 110 (e.g., a drilling, workover, or production riser, such as a catenary riser) which extends through the body of water 106 below a platform 120 (e.g., a drilling, workover, or production vessel or platform). The riser 110 may extend substantially vertically beneath the platform 120 to a point where the riser 110 is connected to further subsea hydrocarbon production equipment. In the embodiment of FIG. 1, the platform 120 is illustrated as a jack-up platform (or jack-up rig). In alternative embodiments, an otherwise similar platform is a fixed platform; a compliant tower; a floating production, storage, and offloading system (FPSO system); a drillship; a spar platform; a tension-moored platform; a semi-submersible platform; or combinations thereof. The platform 120 of FIG. 1 may be configured for subsea wellbore drilling operations; subsea wellbore servicing operations; subsea production, storage, and offloading operations; or combinations thereof. The platform 120 may include a derrick 125, for example, for raising or lowering various subsea production and/or servicing equipment.

In the embodiment of FIG. 1, the subsea hydrocarbon production equipment also includes a template 140 (e.g., a drilling and production template) associated with the wellbore 102, for example, positioned along the sea floor 108 where the wellbore 102 penetrates the subterranean formation 104. The subsea hydrocarbon production equipment may further comprise other various tubular members, for example, one or more pipelines 130 buried beneath or extending along the sea floor 108. The pipelines may be for the purpose of transporting various fluids to or from the wellbore 102, for example, for communicating a produced hydrocarbon away from the wellbore 102. The subsea hydrocarbon production equipment may further comprise various equipment associated with the template 140, for example, equipment such as flow couplings, pipeline joints, landing nipples, circulating devices, pumps, valves, mandrels, travel joints, cross-over joints, blow-out preventers, and combinations thereof. The subsea hydrocarbon production equipment may terminate at the platform 120, thereby providing fluid communication between the pipeline, template, manifold or wellhead and/or the wellbore 102 and the platform 120.

In the embodiment of FIG. 1, the SWP system 100 further comprises a SWP structure 200. The SWP structure 200 is generally configured to enclose and/or otherwise house a portion of the subsea hydrocarbon production equipment. For example, in the embodiment of FIG. 1, the SWP structure 200 generally takes the form of (e.g., comprises) a caisson. Also in the embodiment of FIG. 1, the SWP structure 200 encloses the template 140 (e.g., a drilling and production template), while still allowing various fluid connections, for example, via the riser 110 and/or pipelines 130, as will be explained herein.

Figure 2A:
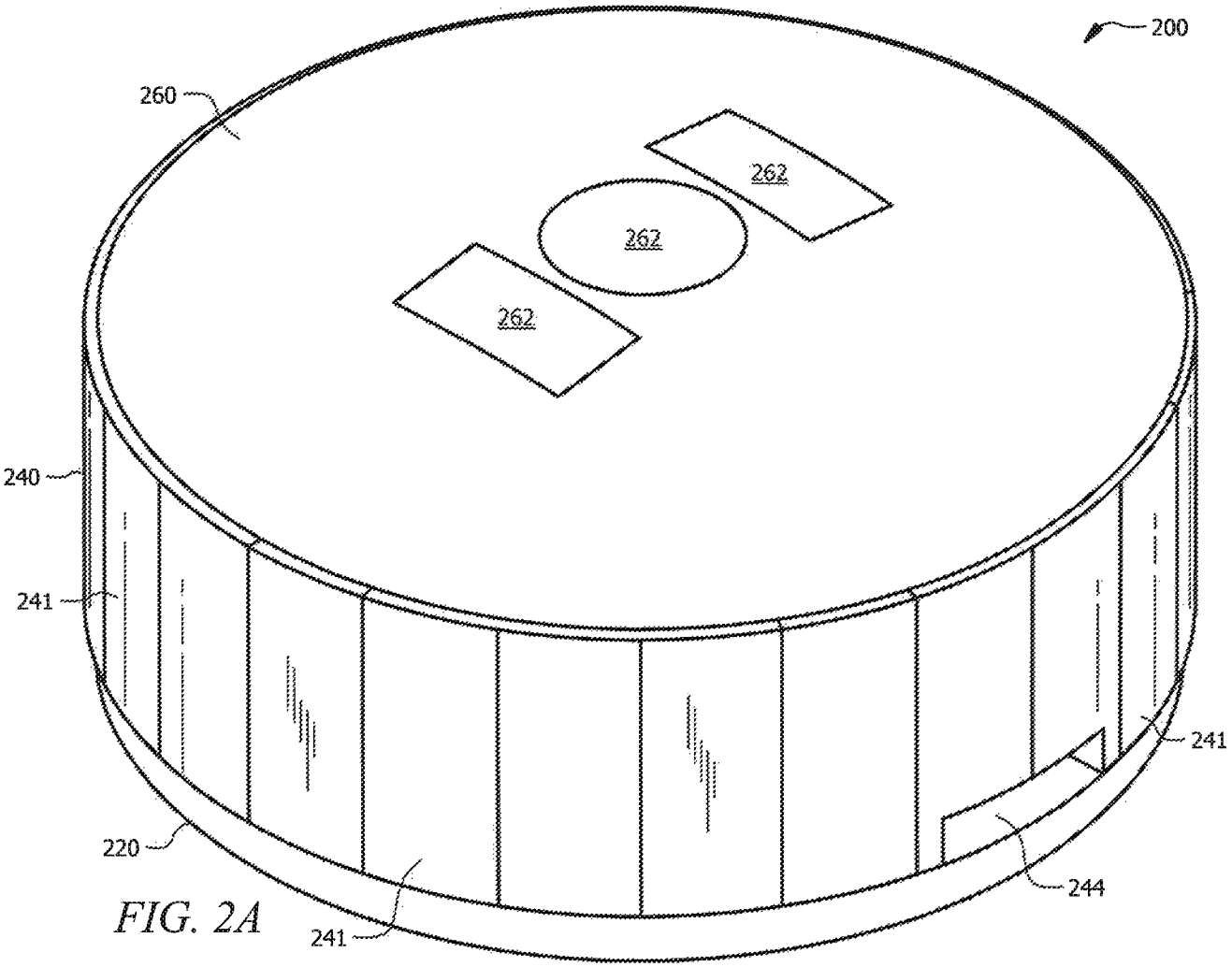
FIGS. 2A and 2B illustrate an embodiment of a SWP structure, as disclosed herein.
Figure 2B:
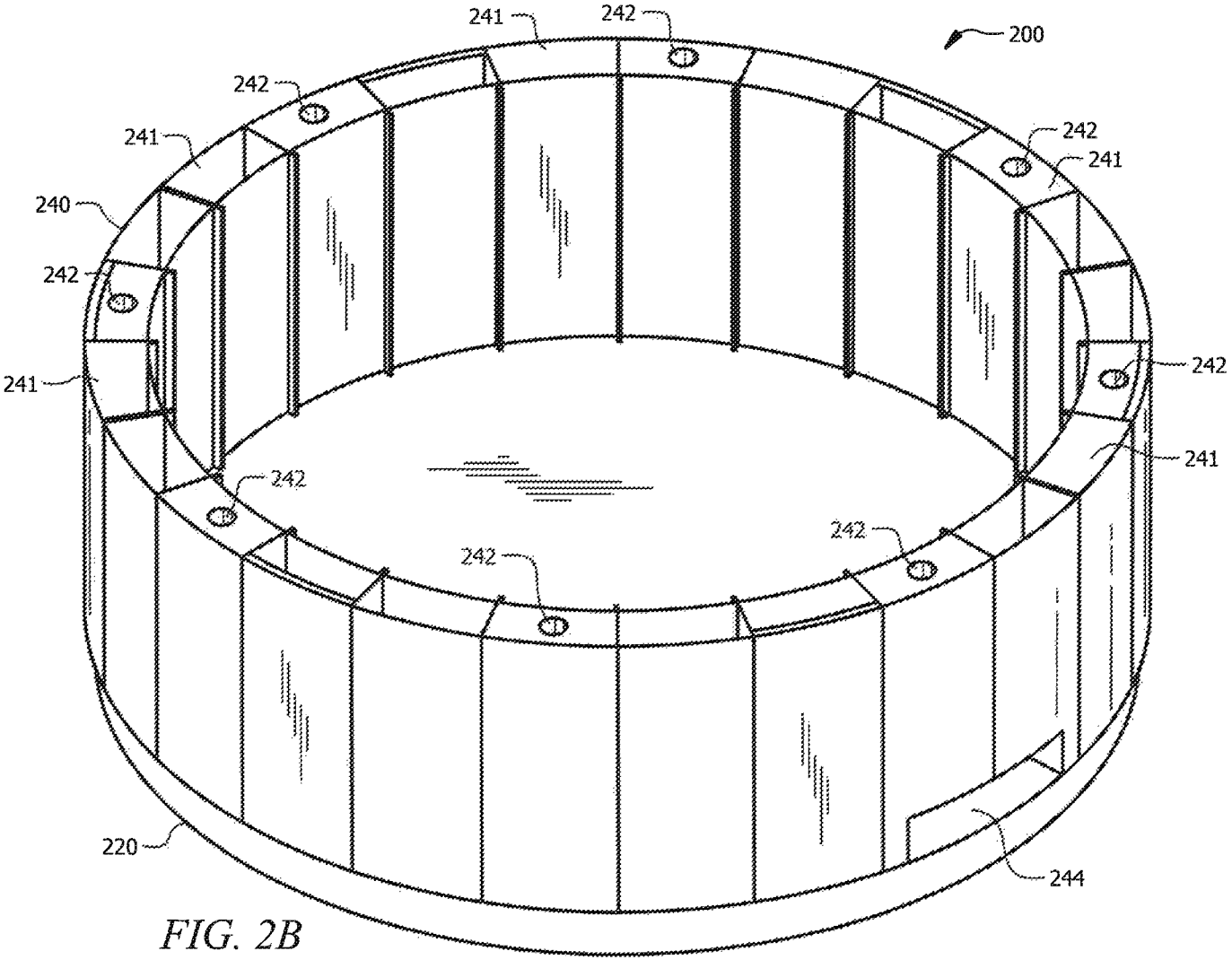

Referring to FIG. 2A, an embodiment of the SWP structure 200 is shown. FIG. 2B illustrates the SWP structure 200 of FIG. 2A with an upper portion thereof removed, for purposes of illustration. The SWP structure 200 generally comprises a floor 220, skirt 240, and cover 260. In the embodiment of FIGS. 2A and 2B, the SWP structure 200 is illustrated as being substantially cylindrical (i.e., have a circular horizontal cross-section). In alternative embodiments, an otherwise similar SWP structure may have any suitable or desired horizontal cross-section shape, for example, the SWP structure (e.g., in horizontal cross-section) may be triangular, square, rectangular, pentagonal, hexagonal, heptagonal, octagonal, nonagonal, decagonal, etc. Additionally, while the perimeter of the SWP structure 200 is illustrated as being relatively constant, in alternative embodiments, the SWP structure 200 may increase or decrease in perimeter over its height, for example, such that the SWP structure 200 generally forms at least a portion of a cone, pyramid (e.g., a triangular, square, pentagonal, etc., pyramid).

In an embodiment, the SWP structure 200 may be configured so as to be fluid-tight or substantially fluid-tight. For example, as will be disclosed herein, the SWP structure 200 may comprise one or more access points and/or one or more ports. In such an embodiment, such access point or ports may be selectively opened and closed.

The SWP structure 200 may be sized so as to accommodate a desired subsea hydrocarbon production component or a desired combination of such components. For example, the SWP structure 200 may have a height of about 30 feet (about 9.1 meters), alternatively, about 40 feet (about 12.2 meters), alternatively, about 50 feet (about 15.2 meters), alternatively, about 60 feet (about 18.3 meters). Also, the SWP structure 200 may have a length and/or width of about 100 feet (about 30.5 meters), alternatively, about 125 feet (about 38.1 meters), alternatively, about 150 feet (about 45.7 meters), alternatively, about 175 feet (about 53.3 meters).

One or more of the floor 220, the skirt 240, and the cover 260 may comprise and be formed from one or more suitable structural members generally configured to provide structural integrity to each of these respective components. Examples of such structural members include, but are not limited to, beams, arches, joists, trusses, girders, and the like. In such an embodiment, the structural members may define the general size and shape of the floor 220, the skirt 240, the cover 260, or components thereof. In some embodiments, the floor 220, the skirt 240, the cover 260, or components thereof may include one or more layers covering the structural members sheathing), for example, steel plating. In an embodiment, the spaces enclosed by the coverings (e.g., the spaces between the sheathing) may be filled with a suitable composition, for example, for adding structural rigidity to the floor 220, the skirt 240, the cover 260, or components thereof and/or altering (i.e., improving) the ballast of the floor 220, the skirt 240, the cover 260, components thereof, or the SWP structure 200 in its entirety. An example of such a filler composition includes concrete.

Referring to FIG. 2B, the floor 220 is generally configured to provide a base for the skirt 240 and cover 260 and, in some embodiments, to provide a base for one or more components of subsea hydrocarbon production equipment (e.g., a drilling and production template). The floor 220 may be circular, triangular, square, pentagonal, etc., for example, corresponding to the shape of the SWP structure 200. The floor 220 may comprise a plurality of attachment points configured to allow the skirt 240 to be secured to the floor 220. For example, the floor 220 may comprise a plurality of holes configured to receive bolts to secure skirt 240 to the floor 220. Additionally or alternatively, the skirt 240 may be permanently attached, for example, via welds, to the floor 220.

The skirt 240 is generally configured to provide upright support to the cover 260 (e.g., dome), for example, thereby defining the interior space of the SWP structure 200. In the embodiment of FIGS. 2A and 2B, the skirt 240 comprises and is formed from a plurality of skirt panels 241, for example, three, four, five, six, seven, eight, nine, 10, 11, 12, or more operably-joined panels. The skirt panels 241 (e.g., at the union between any two adjacent panels) may be joined via a suitable connection, for example, a bolted or welded connection, so as to thereby form the skirt 240.

Referring to FIG. 2B, the skirt 240 comprises a plurality, for example, three, four, five, six, seven, eight, nine, 10, 11, 12, or more, through-bores 242. The through-bores extend generally vertically through the skirt 240 and the floor 220. Each of the through-bores 242 is generally sized and configured to receive and retain an anchor strut. The anchor struts may be configured to provide additional structural rigidity to the skirt 240, to maintain orientation and positioning between the cover 260, skirt 240, and floor 220, to provide vertical support to the covering, and to anchor the cover 260, skirt 240, and floor 220 when positioned on the sea floor.

As also shown in the embodiment of FIGS. 2A and 2B, the skirt further comprises at least one side port 244. The side port(s) 244 may serve as a passageway for one or more conduits, for example, pipeline 130. The side port(s) 244 may be positioned so as to allow access to subsea wellbore equipment (e.g., the drilling and production template), for example, the sides port(s) may be aligned with a given connection point to the wellbore equipment.

Referring to FIG. 2A, the cover 260 is generally configured to provide an upper bound to the interior space of the SWP structure 200. While the embodiment of FIGS. 1 and 2A illustrate the cover as having a domed shape, in alternative embodiments, the cover 260 may comprise any suitable shape. As will be disclosed herein, the cover 260 may be configured to support substantial weight, for example, weight applied to the cover 260.

The cover 260 comprises one or more access points 262. For example, in the embodiment of FIG. 2A, the cover 260 comprises three access points 262. In alternative embodiments, the cover 260 may comprise any suitable number and configuration of similarly-configured access points.

In an embodiment, an access point 262 may be configured to allow access to and communication with the subsea wellbore equipment retained within the SWP structure 200. For example, in the embodiment of FIG. 1 where the riser 110 is connected to the drilling and production template 140 within the SWP structure 200, an access point 262 may be aligned with (e.g., coaxial with) a connection point on the drilling and production template. For example, referring again to FIG. 2A, two of the access points 262 (e.g., the rectangular, off-center access points) are shown as would be suitable for providing a connection to the bore locations of a 4-hole drilling and production template; for example, a first of the rectangular access points would provide connection to two of the bore locations on the template, and the second of the rectangular access points would provide connection to the two remaining bore locations on the template.

The access points 262 may also be configured for the passage of wellbore servicing equipment into the interior space of the SWP structure 200, for example, equipment such as a Remotely-Operated Vehicle (ROV). For example, in the embodiment of FIG. 2A, the center, circular access point may be suitable for the passage of an ROV.

In various embodiments, the access points 262 may be selectively sealable. For example, the access points 262 may be any suitable configuration of panel, door, hatch, or the like that may be opened or closed as desired by an operator. For example, an access point may be configured as a folding hatch, a removable (e.g., liftable) hatch, a rolling or sliding hatch, or any other suitable configuration. Such a hatch may be configured so as to be opened or closed remotely, for example, via the operation of one or more actuators. Additionally or alternatively, such a hatch may be configured to be opened or closed via the operation of a ROV.

In an embodiment, such a hatch may be fluid-tight or substantially fluid-tight, for example, such that when closed, the access-points 262 do not permit the passage of water or air. In an embodiment, an access point 262 may comprise or be configured to operate as a pressure relief valve. For example, in such an embodiment, the access point 262 may be configured to open or to fail mechanically upon experiencing a pressure in excess of a particular pressure threshold. Alternatively, the SWP structure may comprise a pressure relief valve separate from the access point.

Also disclosed herein are embodiments of methods for drilling and producing hydrocarbons from a subterranean formation beneath a body of water. In various embodiments, one or more of the methods disclosed herein may include deploying and using the disclosed SWP systems 100 and/or the disclosed SWP structure 200 and/or using the disclosed SWP systems 100 and/or the disclosed SWP structure 200.

Referring to FIGS. 3-7, a method of deploying the SWP structure 200 is illustrated. In the embodiment of FIGS. 3-7, the SWP structure 200 may be deployed below the sea floor 108, for example, such that an uppermost point of the SWP structure 200 (e.g., the cover 260) is a desired depth below the sea floor, referred to herein as "below-grade." For example, the SWP structure 200 may be deployed such that the uppermost point of the SWP structure 200 is about 3 feet (about 1 meter), alternatively, about 4.5 feet (about 1.5 meters), alternatively, about 6 feet (about 1.8 meters), alternatively, about 9 feet (about 2.7 meters) below the sea floor 108. In an alternative embodiment, the SWP structure 200 may be deployed on the sea floor 108, referred to herein as "on-grade."

In an embodiment where the SWP structure 200 is deployed below-grade, the method of deploying the SWP system 200 comprises the steps of excavating (e.g., dredging) a below-grade space (e.g., a "glory-hole") at the intended deployment location; positioning the SWP structure 200 at the deployment location; and replacing at least a portion of the dredged material in the below-grade space.

Figure 3:
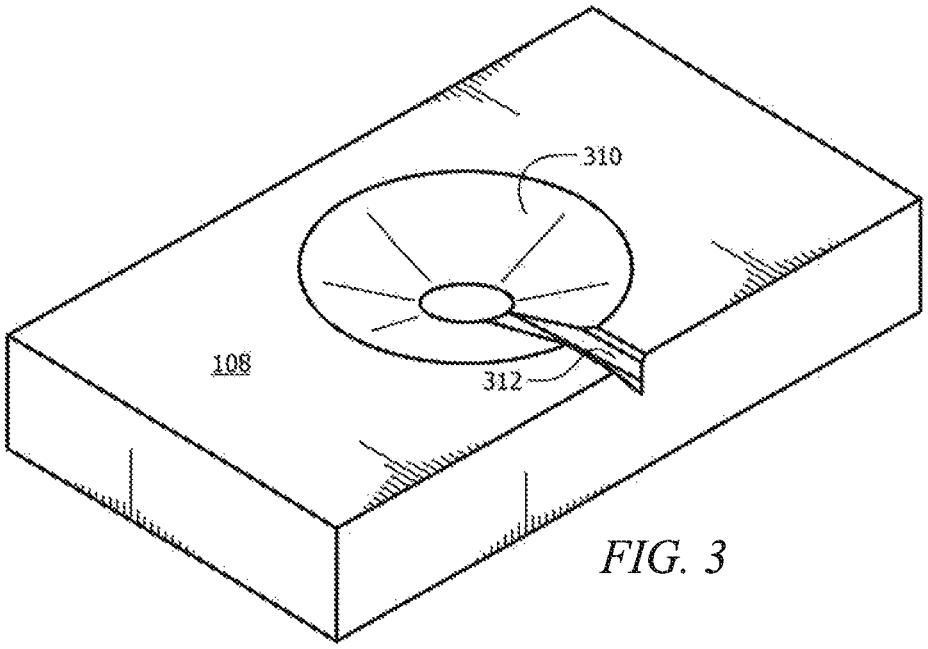
FIGS. 3-10 illustrate methods of an embodiment of various steps of using a SWP system, as disclosed herein.

In such an embodiment and referring to FIG. 3, excavating the below-grade space 310 (e.g., glory-hole) at the intended deployment location may be carried out in any suitable manner, for example, employing conventional dredging techniques. The below-grade space 310 may be dredged to a sufficient depth such that, when the SWP structure 200 is deployed, the uppermost point of the SWP structure 200 is below the level of the sea floor 108 by a desired depth. For example, the SWP structure 200 may be deployed such that the uppermost point of the SWP structure 200 is about 3 feet (about 1 meter), alternatively, about 4.5 feet (about 1.5 meters), alternatively, about 6 feet (about 1.8 meters), alternatively, about 9 feet (about 2.7 meters) below the sea floor 108.

Additionally, in an embodiment, one or more trenches 312 may be excavated beneath the sea floor 108, for example, in which one or more pipelines 130 may be buried. The trenches may be excavated in any suitable manner, for example, using a trailing suction hopper dredge. For example, referring to FIG. 4, pipelines 130 (and, additionally or alternatively, power cables, control cables, or the like) may be placed within the excavated trench 312.

Figure 4:
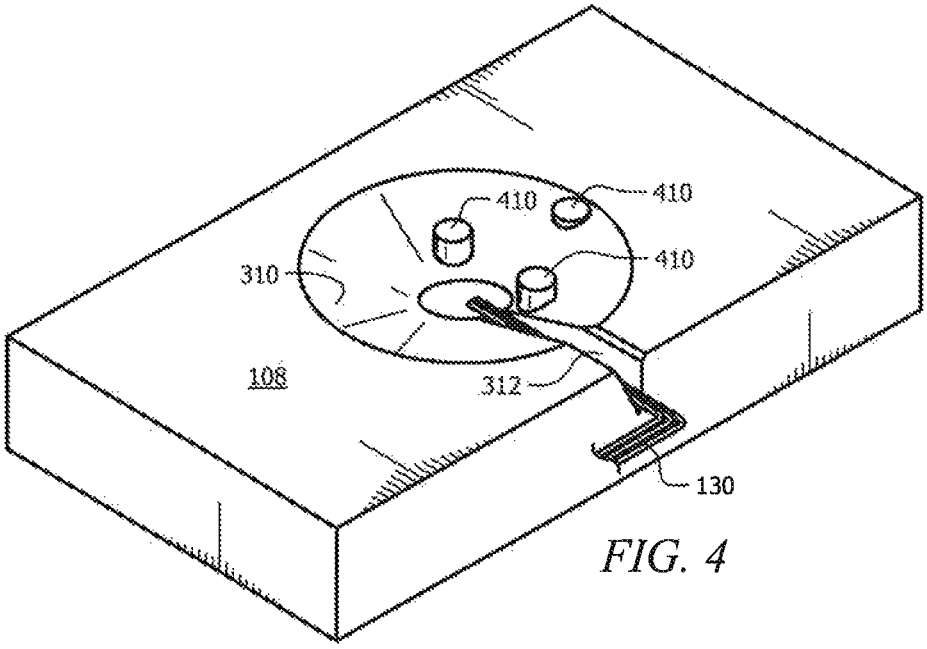
Figure 5:
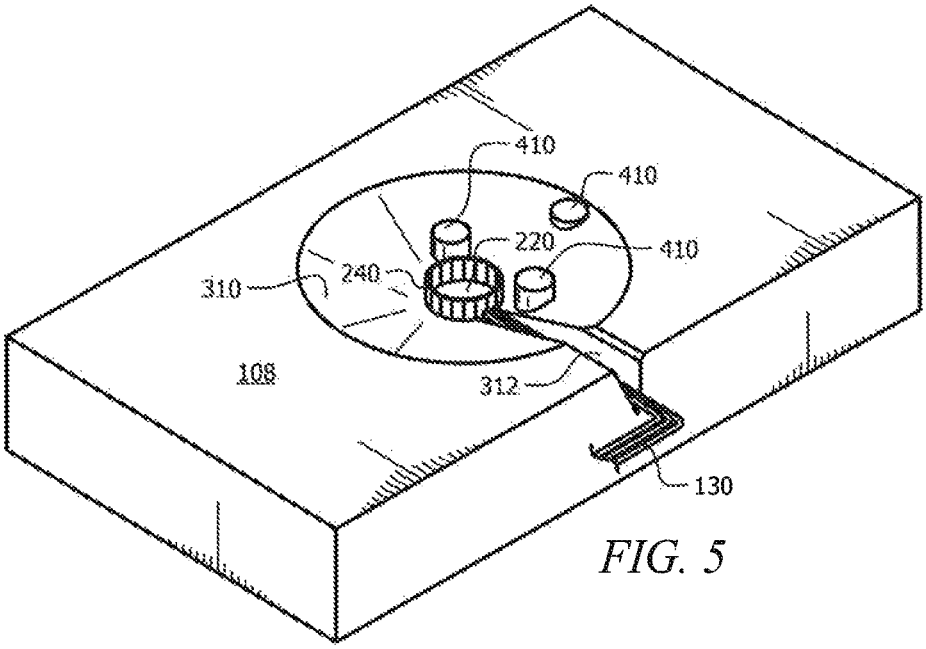
Figure 6:
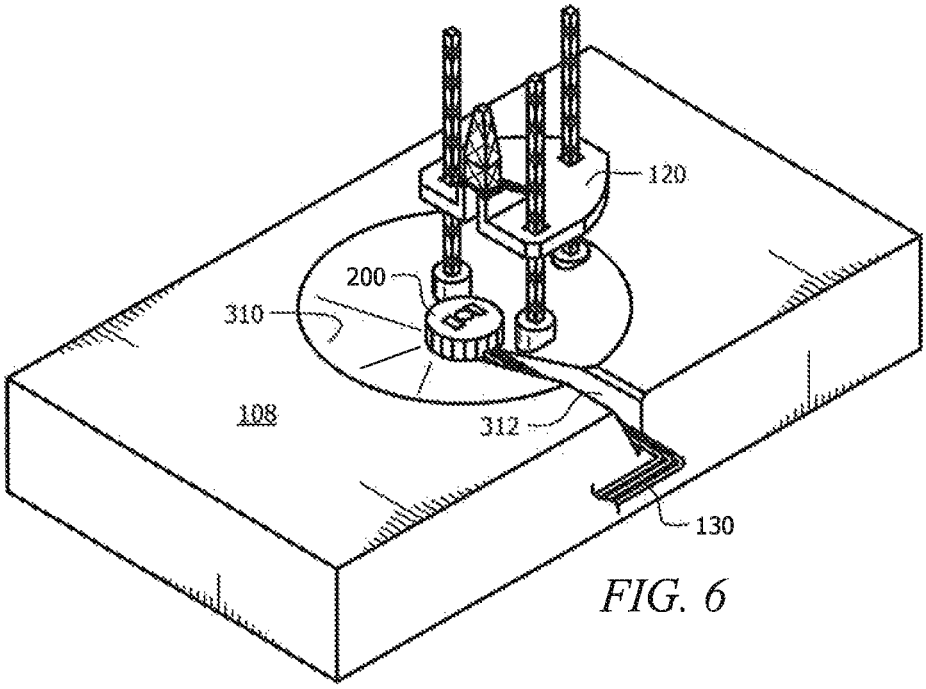

Additionally, and also in reference to FIG. 4, in an embodiment where the platform 120 comprises a jack-up configuration, the foundational structures 410 that will support the platform may also be provided prior to positioning the SWP structure within the below-grade space 310, as will be disclosed herein.

In an embodiment, positioning the SWP structure 200 at the deployment location may comprise lowering the SWP structure 200 into the desired position in a fully or substantially assembled state, for example, with the floor 220, skirt 240, and cover 260 secured to each other and one or more desired subsea wellbore equipment components (e.g., a template) positioned and secured within the SWP structure 200. In such an embodiment, the SWP structure 200 may be lowered into place from above via the operation of one or more suitably-configured surface vessels. Additionally or alternatively, the SWP structure 200 may be configured so as to be buoyant or so as to exhibit improved buoyancy. For example, in such an embodiment, the SWP structure 200 may be sealed such that the interior chamber of the SWP structure 200 does not flood when placed in the body of water. Additionally, one or more buoyancy-enhancing supports (e.g., "floats" or buoys) may be attached to the SWP structure 200 to similarly improve the buoyancy of the SWP structure 200. The SWP structure may be lowered into place, for example, assisted by ROVs, as the buoys and/or the interior of the SWP structure 200 are slowly and selectively flooded.

In an alternative embodiment, the SWP structure 200 may be assembled in place. For example, in such an embodiment, the various components of the SWP structure 200 may be separately brought into position and then secured together in place, for example, via the operation of one or more ROVs. For example, referring to FIG. 5, the floor 220 and skirt 240 have been lowered into position within the below-grade space 310 and, in FIG. 6, the cover 260 has been lowered into place and secured to the skirt 240. Also in FIG. 6, the platform 120 has been assembled.

In an embodiment, the SWP structure may be anchored into the sea floor 108 upon being positioned as desired. For example, as disclosed herein, one or more anchor struts extending vertically through the skirt 240 and floor 220 may be pressed into the sea floor 108, for example, as the SWP structure 200 is positioned.

Figure 7:
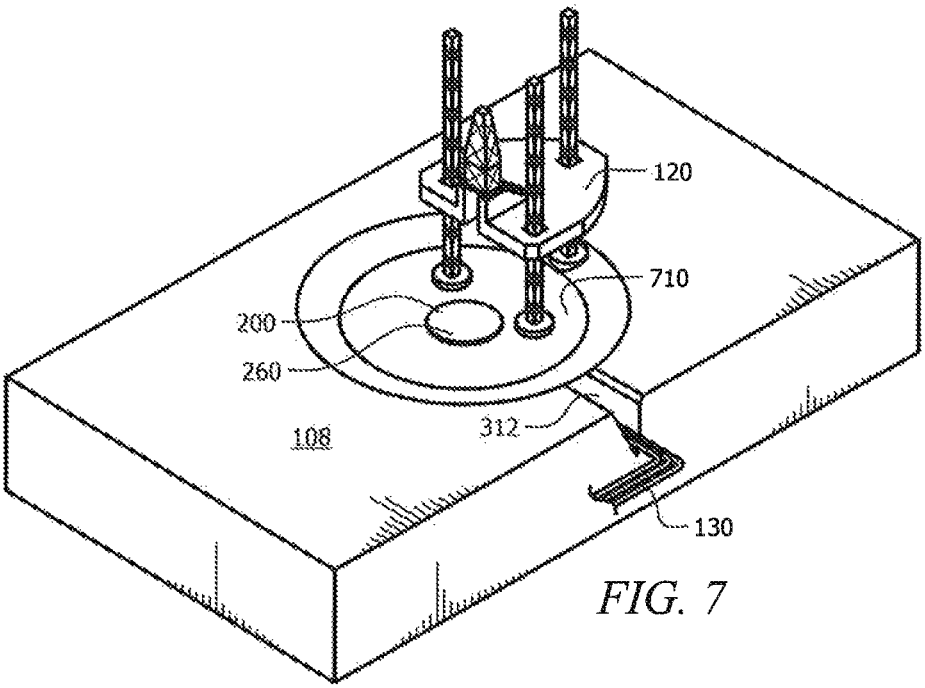

Referring to FIG. 7, in an embodiment, with the SWP structure 200 is position within the below-grade space 310 at the intended deployment location, at least a portion of the dredged material taken from the below-grade space may be replaced, for example, such that at least a portion of the SWP structure 200 is surrounded by fill material 710 and the cover 260 (e.g., one or more access points 262 thereof) remains at least partially exposed and/or accessible. In such an embodiment, at least a portion of the material removed during dredging may be returned to the below-grade space 310 or, in an alternative embodiment, the removed material may be replaced with gravel or another suitable filling material.

Figure 8:
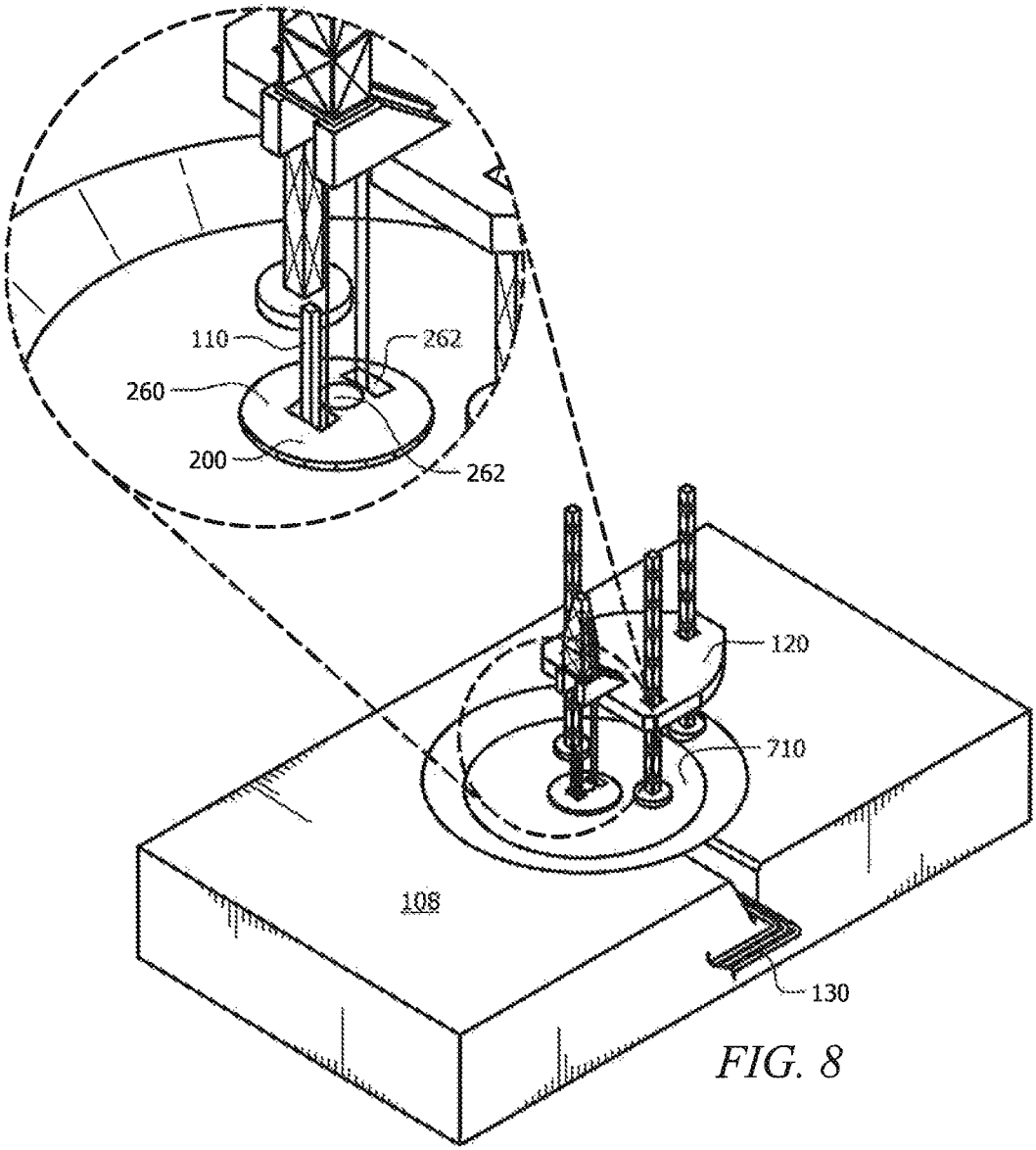

Referring to FIG. 8, a method of using the deployed SWP structure 200, as disclosed herein, in the context of a subsea drilling operation is disclosed. In the embodiment of FIG. 8, the method generally comprises providing access to an interior space defined by the SWP structure 200 via one or more of the access points 262, for example, by removing or opening the panel, door, hatch, or the like, dependent upon the configuration of the access points 262. Also in the embodiment of FIG. 8, the method may comprise lowering wellbore servicing equipment, via one or more of the access points 262, into position for the performance of the drilling operation. Such wellbore servicing equipment may, in various embodiments, include a guideline, riser 110, ROV, BOP or other wellhead equipment, or other conventionally-employed subsea wellbore drilling equipment. More particularly, the equipment may be lowered through the access points to the drilling and production template 140. With the wellbore drilling equipment in place, the subsea drilling operation may proceed as conventional. One or more steps for using the deployed SWP structure 200 in the context of a subsea drilling operation may be repeated for any additional hole associated with the drilling and production template, for example, as desired by an operator.

Figure 9:
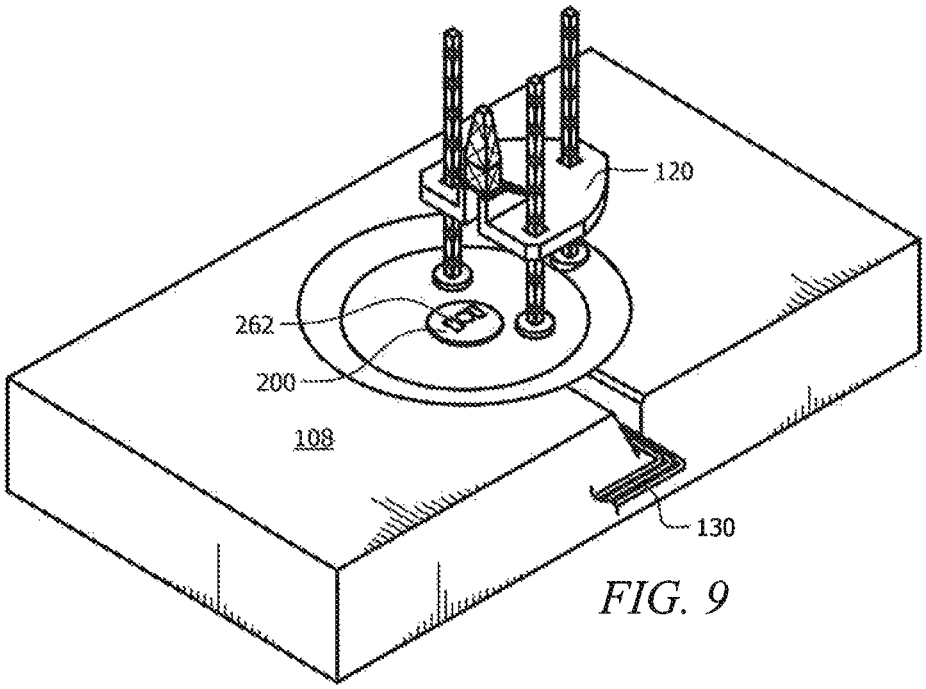
Figure 10:
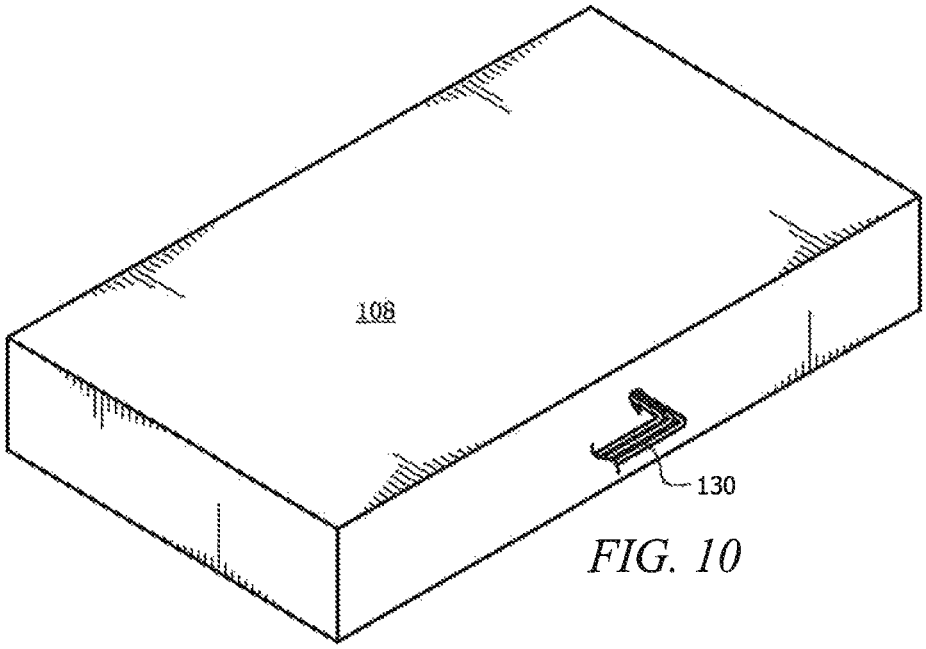

Referring to FIGS. 9 and 10, a method of using the deployed SWP structure 200, as disclosed herein, during a production operation from the wellbore is also disclosed. In the embodiment of FIG. 9, with the drilling operations completed, some of the subsea wellbore equipment (e.g., drilling risers, surface connections, ROVs, etc.) may be removed from the SWP structure and the access points 262 closed, for example, by closing or replacing doors or panels.

Referring to FIG. 10, with the access points 262 again closed, the platform 120 may be removed and the remaining, unfilled portion of the below-grade space 310 may be filled (e.g., with a suitable fill material, such as gravel or the dredged materials) such that the sea floor 108 is returned to its prior level.

In an embodiment, the interior space defined by the SWP structure 200 may be observed during the production operation, for example, by including lights and/or cameras within the structure. Also, in an embodiment, a ROV may be housed within the SWP structure 200, for example, for long-term maintenance if needed. Additionally, sensors can be placed within the SWP structure, for example, to monitor the environment therein, for example, so as to detect leaks or malfunctions from the subsea equipment (e.g., the wellbore or BOP).

In an embodiment, in the event that access to the well is required (e.g., for a workover operation or repair), the SWP structure 200 may be uncovered (e.g., by dredging) with the equipment accessed via the access point 262 as previously disclosed.

The embodiments of a SWP system, a SWP structure, and methods disclosed herein may be advantageously employed in a subsea wellbore environment.

For example, in particularly cold and shallow environments, sea ice can pose a substantial threat of damage to subsea wellbore equipment of the type discussed herein. More particularly, the potential for intrusion and/or gouging by ice keels in such environments is substantial and, if experienced, could yield catastrophic industrial losses and/or environmental damage. By retaining the subsea wellbore equipment in a below-grade environment, (i.e., the SWP structure as disclosed herein), the risk of damage by seabed gouging is mitigated. More particularly, and as disclosed herein, the SWP structure (e.g., a caisson) may be buried sufficiently below grade, such that the uppermost point of the SWP structure 200 is about 3 feet (about 1 meter), alternatively, about 4.5 feet (about 1.5 meters), alternatively, about 6 feet (about 1.8 meters alternatively, about 9 feet (about 2.7 meters) below the sea floor 108, that there is effectively no risk of damage to the wellbore equipment by gouging. For example, the depth at which the SWP structure is buried at a depth greater than the depth, which may be calculated, as might result from one or more gouging incidents (e.g., by an ice keel).

Additionally, the SWP structures disclosed herein may also provide a secured environment for the subsea wellbores, for example, such that fluid leaks resulting from a subsea equipment failure may be retained within the internal al space defined by the SWP structure, thereby lessening the risk of environmental damage as might result from an equipment failure.

ADDITIONAL EMBODIMENTS

A first embodiment of a subsea wellbore protection (SWP) system comprises a wellbore penetrating a subterranean formation beneath a sea floor; a SWP structure positioned below-grade with respect to the sea floor, wherein the SWP structure comprises a caisson that encloses a first wellbore equipment component in fluid communication with the wellbore.

A second embodiment, which is the system of the first embodiment, wherein the caisson comprises a cylindrical shape.

A third embodiment, which is the system of one of the first through the second embodiments, wherein the caisson comprises a floor, a skirt, and a cover.

A fourth embodiment, which is the system of the third embodiment, wherein the cover is substantially dome-shaped.

A fifth embodiment, which is the system of the third through the fourth embodiments, wherein the cover comprises a plurality of access points, wherein each of the access points is configured to allow passage of a second wellbore equipment component or a portion thereof.

A sixth embodiment, which is the system of the fifth embodiment, wherein the second wellbore equipment component comprises a riser, a blow-out preventer, a remotely-operated vehicle, a wellhead component, or combinations thereof.

A seventh embodiment, which is the system of the fifth embodiment, wherein the access points comprise doors, hatches, or panels.

An eighth embodiment, which is the system of one of the third through the seventh embodiments, wherein the caisson further comprises a safety relief valve.

A ninth embodiment, which is the system of one of the first through the eighth embodiments, wherein the first wellbore equipment component comprises a drilling and production template.

A tenth embodiment, which is the system of one of the first through the ninth embodiments, further comprising a pipeline in fluid communication with the wellbore, wherein the pipeline is positioned below-grade with respect to the sea floor.

An eleventh embodiment, which is a method of deploying a subsea wellbore protection (SWP) system, the method comprising excavating a well-site to a depth below a sea floor; and positioning a SWP structure within the excavated well-site and below-grade with respect to the sea floor, wherein the SWP structure comprises a caisson that encloses a first wellbore equipment component.

A twelfth embodiment, which is the method of the eleventh embodiment, further comprising placing a fill material in the excavated well-site, such that at least a portion of the SWP structure is buried.

A thirteenth embodiment, which is the method of one of the eleventh through the twelfth embodiments, wherein the caisson comprises a cylindrical shape.

A fourteenth embodiment, which is the method of one of the eleventh through the thirteenth embodiments, wherein the caisson comprises a floor, a skirt, and a cover.

A fifteenth embodiment, which is the method of the fourteenth embodiment, wherein the cover is substantially dome-shaped.

A sixteenth embodiment, which is the method of one of the fourteenth through the fifteenth embodiments, further comprising providing access to an interior space defined by the caisson via at least one of a plurality of access points within the cover.

A seventeenth embodiment, which is the method of the sixteenth embodiment, wherein a second wellbore equipment component comprises a riser, a blow-out preventer, a remotely-operated vehicle, a wellhead component, or combinations thereof.

An eighteenth embodiment, which is the method of one of the sixteenth through the seventeenth embodiments, wherein the access points comprise doors, hatches, or panels.

A nineteenth embodiment, which is the method of one of the eleventh through the eighteenth embodiments, wherein the first wellbore equipment component comprises a drilling and production template.

A twentieth embodiment, which is the method of one of the eleventh through the nineteenth embodiments, further comprising positioning a pipeline below-grade with respect to the sea floor; and providing a fluid connection between the pipeline and the first wellbore equipment component.

While embodiments of the disclosure have been shown and described, modifications thereof can be made without departing from the spirit and teachings of the invention. The embodiments and examples described herein are exemplary only, and are not intended to be limiting. Many variations and modifications of the invention disclosed herein are possible and are within the scope of the invention.

At least one embodiment is disclosed, and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claims. Use of broader terms such as comprises, includes, and having should be understood to provide support for narrower terms such as consisting of, consisting essentially of, and comprised substantially of.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the detailed description of the present invention. The disclosures of all patents, patent applications, and publications cited herein are hereby incorporated by reference.

What is claimed is:

1. A subsea wellbore protection (SWP) system comprising:

a wellbore penetrating a subterranean formation beneath a sea floor; and a SWP structure positioned below-grade with respect to the sea floor, wherein the SWP structure comprises a caisson that encloses a first wellbore equipment component in fluid communication with the wellbore;

wherein the caisson comprises a floor, a skirt seated above the floor of the caisson, and a cover coupled to an upper end of the skirt, wherein the skirt defines an outer wall of the caisson and supports the cover above the floor, wherein the outer wall has an inner surface extending around the first wellbore equipment component and an outer surface extending around the first wellbore equipment component, wherein a plurality of circumferentially-spaced through-bores extend vertically through the outer wall and the floor of the caisson, wherein each through-bore is positioned between the inner surface and the outer surface of the outer wall, and wherein each through-bore is configured to receive an anchor strut.

2. The system of claim 1, wherein the caisson comprises a cylindrical shape.

3. The system of claim 1, wherein the cover is substantially dome-shaped.

4. The system of claim 1, wherein the cover comprises a plurality of access points, wherein each of the access points is configured to allow passage of a second wellbore equipment component or a portion thereof.

5. The system of claim 4, wherein the second wellbore equipment component comprises a riser, a blow-out preventer, a remotely-operated vehicle, a wellhead component, or combinations thereof.

6. The system of claim 4, wherein the access points comprise doors, hatches, or panels.

7. The system of claim 1, wherein the caisson further comprises a safety relief valve.

8. The system of claim 1, wherein the first wellbore equipment component comprises a drilling and production template.

9. The system of claim 1, wherein an uppermost point of the cover is at least 3 feet below the sea floor.

10. The system of claim 1, further comprising a pipeline in fluid communication with the wellbore, wherein the pipeline is positioned below-grade with respect to the sea floor.

11. A method of deploying a subsea wellbore protection (SWP) system, the method comprising:

excavating a well-site to a depth below a sea floor; and positioning a SWP structure within the excavated well-site and below-grade with respect to the sea floor, wherein the SWP structure comprises a caisson that encloses a first wellbore equipment component;

wherein the caisson comprises a floor, a skirt seated above the floor of the caisson, and a cover coupled to an upper end of the skirt, wherein the skirt defines an outer wall of the caisson and supports the cover above the floor, wherein the outer wall has an inner surface extending around the first wellbore equipment component and an outer surface extending around the first wellbore equipment component, wherein a plurality of circumferentially-spaced through-bores extend vertically through the outer wall and the floor of the caisson, wherein each through-bore is positioned between the inner surface and the outer surface of the outer wall, and wherein each through-bore is configured to receive an anchor strut.

12. The method of claim 11, further comprising placing a fill material in the excavated well-site, such that at least a portion of the SWP structure is buried.

13. The method of claim 11, wherein the caisson comprises a cylindrical shape.

14. The method of claim 11, wherein the cover is substantially dome-shaped.

15. The method of claim 11, further comprising providing access to an interior space defined by the caisson via at least one of a plurality of access points within the cover.

16. The method of claim 15, wherein a second wellbore equipment component comprises a riser, a blow-out preventer, a remotely-operated vehicle, a wellhead component, or combinations thereof.

17. The method of claim 15, wherein the access points comprise doors, hatches, or panels.

18. The method of claim 11, wherein the first wellbore equipment component comprises a drilling and production template.

19. The method of claim 11, further comprising:

positioning a pipeline below-grade with respect to the sea floor; and providing a fluid connection between the pipeline and the first wellbore equipment component.

20. The method of claim 11, wherein an uppermost point of the cover is at least 3 feet below the sea floor.

* * * * *